US007645317B2

(12) United States Patent
Fujiura et al.

(10) Patent No.: US 7,645,317 B2
(45) Date of Patent: Jan. 12, 2010

(54) MIXED POWER FOR POWDER METALLURGY, GREEN COMPACT THEREOF, AND SINTERED BODY

(75) Inventors: Takayasu Fujiura, Kobe (JP); Yasuko Yakou, Kobe (JP); Satoshi Nishida, Takasago (JP); Yuuji Taniguchi, Takasago (JP); Tetsuya Goto, Takasago (JP)

(73) Assignee: Kabushiki Kaisha Kobe Seiko Sho, Hyogo (JP)

( * ) Notice: Subject to any disclaimer, the term of this patent is extended or adjusted under 35 U.S.C. 154(b) by 15 days.

(21) Appl. No.: 12/087,856

(22) PCT Filed: Mar. 13, 2007

(86) PCT No.: PCT/JP2007/054991

§ 371 (c)(1),
(2), (4) Date: Jul. 16, 2008

(87) PCT Pub. No.: WO2007/119346

PCT Pub. Date: Oct. 25, 2007

(65) Prior Publication Data

US 2009/0007725 A1 Jan. 8, 2009

(30) Foreign Application Priority Data

Mar. 14, 2006 (JP) ..... 2006-069731
Mar. 14, 2006 (JP) ..... 2006-069732

(51) Int. Cl.
*B22F 1/00* (2006.01)
*B22F 3/00* (2006.01)

(52) U.S. Cl. ..... 75/252; 75/246

(58) Field of Classification Search ..... 75/252, 75/246

See application file for complete search history.

(56) References Cited

U.S. PATENT DOCUMENTS 3,853,572 A * 12/1974 Herron et al. ..... 75/231
2002/0004540 A1 1/2002 Hendrickson et al.
2004/0168547 A1 9/2004 Fujisawa et al.
2004/0226404 A1 * 11/2004 Ozaki et al. ..... 75/252
2006/0000310 A1 1/2006 Solimnjad

FOREIGN PATENT DOCUMENTS

| | | |
|---|---|---|
| JP | 2003-105405 | 9/2001 |
| JP | 2004-115882 | 9/2002 |
| JP | 2004-256899 | 2/2003 |
| JP | 2004-360008 | 6/2003 |
| JP | 2004-162170 | 7/2003 |
| TW | 200605973 | 7/2005 |
| WO | WO 2006/004530 | 12/2006 |

OTHER PUBLICATIONS

International Search Report of PCT/JP2007/054991 mailed Jun. 12, 2007.

* cited by examiner

*Primary Examiner*—Roy King
*Assistant Examiner*—Ngoclan T Mai
(74) *Attorney, Agent, or Firm*—Stites & Harbison PLLC; Juan Carlos A. Marquez, Esq.

(57) ABSTRACT

The present invention relates to a mixed powder for powder metallurgy containing an iron-base powder and a carbon supply component, in which the carbon supply component contains a graphite powder and a carbon black, and in which a mixing ratio of the graphite powder to the carbon black is in the range of 25 to 85 parts by weight to 75 to 15 parts by weight; and a mixed powder for powder metallurgy containing an iron-base powder and a carbon supply component, in which the carbon supply component contains, as a main component, a carbon black having a dibutyl phthalate absorption of 60 mL/100 g or less and a nitrogen absorption specific surface area of 50 $m^2/g$ or less.

The mixed powder for powder metallurgy of the invention is less in the dust generation and segregation of the carbon supply component. Additionally, when the mixed powder for powder metallurgy of the invention is used, a green compact and a sintered body excellent in the mechanical property can be produced.

12 Claims, 1 Drawing Sheet

MIXED POWER FOR POWDER METALLURGY, GREEN COMPACT THEREOF, AND SINTERED BODY

TECHNICAL FIELD

The present invention relates to a mixed powder for powder metallurgy having less spattering and segregation of a carbon supply component, a high-density green compact obtainable by using the mixed powder for powder metallurgy, and a sintered body obtainable by sintering the green compact.

BACKGROUND ART

A powder metallurgy process employing an iron-base powder to produce a product such as a sintered body is superior to other processes in terms of the cost, dimensional precision of products and productivity. Accordingly, the powder metallurgy process is widely used.

In the powder metallurgy process, a raw material powder containing an iron-base powder is mixed, followed by pressure to form a green compact, further followed by sintering at a temperature equal to or less than a melting point, whereby a sintered body is produced. Among these, a mixing step is a very important operation in view of improving the handling property of a mixed powder to improve the operation efficiency in the pressure forming step to thereby obtain a homogeneous sintered body. In the mixing step, usually, in a raw material powder in which a predetermined carbon supply component (carbon source) is added to the iron-base powder, a lubricant is added to improve the lubrication, followed by mixing.

Conventionally, as the carbon supply component, a graphite powder which is cheap and readily available is widely used.

However, when the graphite powder is used, there is a problem in that, in the mixing or pressure forming step, the graphite powder generates dust (spatter) to deteriorate the handling property of the mixed powder and a working environment. Furthermore, the graphite powder is different in a particle diameter as compared with the iron-base powder and largely different as well in the specific gravity therefrom. Accordingly, even when these are once homogeneously mixed in a mixer, during handling thereafter, separation and segregation (particle size segregation, specific gravity segregation) tend to take place.

In this connection, conventionally, as a method of inhibiting the graphite powder from segregating, a binder (bond) is used.

However, the binder usually has a tackiness and deteriorates the fluidity of the mixed powder. In the case that the fluidity of the mixed powder is poor, for example, in the pressure forming step such as when the mixed powder is exhausted from a storage hopper and sent to a forming mold or when the mixed powder is filled in a forming mold, problems that an exhaust defect owing to bridging or the like is caused at an upper portion of the exhaust of the storage hopper, and that a hose from the storage hopper to a shoe box is clogged, may occur. Furthermore, when the fluidity of the mixed powder is poor, there is another problem in that, since it becomes difficult to evenly fill the mixed powder in an entire forming mold (in particular, a thin portion), whereby it is difficult to obtain a homogeneous green compact.

In order to overcome the problems caused by the binder, patent documents 1 through 3 disclose novel binders which is capable of inhibiting the graphite powder from segregating and improving the fluidity of the mixed powder. However, when these binders are used, there are problems in that the density of the green compact cannot be sufficiently heightened and it is difficult to obtain a sintered body high in the strength and hardness.

Furthermore, in the conventional processes in which a binder is used, a step of adding a binder in the mixed powder followed by mixing is separately necessary. Accordingly, the productivity is inevitably deteriorated.

On the other hand, in patent documents 4 and 5, as the carbon supply component, carbon black is exemplified as well as graphite powder. However, in a column of examples, only the experimental results in which graphite powder is used are described and an experimental result in which carbon black is used is not at all described.

Patent document 1: JP-A 2003-105405
Patent document 2: JP-A 2004-256899
Patent document 3: JP-A 2004-360008
Patent document 4: JP-A 2004-162170
Patent document 5: JP-A 2004-115882

DISCLOSURE OF THE INVENTION

The invention was carried out in view of the foregoing situations, and an object of the invention is to provide a mixed powder for powder metallurgy, which can inhibit a carbon supply component from generating dust and segregating without using a binder, and is homogeneous.

Another object of the invention is to provide a mixed powder for powder metallurgy, which is provided with the foregoing characteristics and can produce a green compact excellent in the mechanical characteristics and a homogeneous sintered body.

Furthermore, still another object of the invention is to provide a green compact which has high density and is excellent in the shape retention property.

Still furthermore, another object of the invention is to provide a sintered body which has high strength and high hardness and is excellent in the mechanical characteristics.

Namely, the invention relates to a mixed powder for powder metallurgy, comprising:

an iron-base powder; and a carbon supply component, wherein the carbon supply component comprises a graphite powder and a carbon black, and wherein a mixing ratio of the graphite powder to the carbon black is in the range of 25 to 85 parts by weight to 75 to 15 parts by weight.

In the mixed powder for powder metallurgy, it is preferred that the phthalic acid absorption of the carbon black is 60 mL/100 g or less and the nitrogen absorption specific surface area of the carbon black is 50 $m^2/g$ or less.

Furthermore, the invention also relates to a mixed powder for powder metallurgy, comprising:

an iron-base powder; and a carbon supply component, wherein the carbon supply component comprises, as a main component, a carbon black having a dibutyl phthalate absorption of 60 mL/100 g or less and a nitrogen absorption specific surface area of 50 $m^2/g$ or less.

Herein, the term "main component" means that the carbon supply component contains only the carbon black or that a component largest in the ratio in the carbon supply component is carbon black.

In the mixed powder for powder metallurgy, it is preferred that the carbon supply component is contained in a proportion of 4 parts by weight or less with respect to 100 parts by weight of the iron-base powder. In this regard, the preferable lower limit of the amount of the carbon supply component is 0.1 parts by weight.

It is preferable that the mixed powder for powder metallurgy further contains a physical property-improving component.

It is preferable that the mixed powder for powder metallurgy further contains a lubricant.

A green compact of the invention, which can overcome the above-mentioned problems, can be obtained by using any one of the above-described mixed powder for powder metallurgy.

A sintered body of the invention, which can overcome the above-mentioned problems, can be obtained by sintering the green compact.

According to the invention, a mixed powder which is capable of reducing dust generation or segregation of the carbon supply component can be obtained without employing a binder. Accordingly, the productivity is excellent.

Furthermore, when the mixed powder of the invention for powder metallurgy is used, a green compact which has high density and is excellent in the shape retention property can be obtained. Accordingly, a sintered body excellent in the mechanical characteristics can be finally obtained.

DESCRIPTION OF THE REFERENCE NUMERALS

Figure 1:
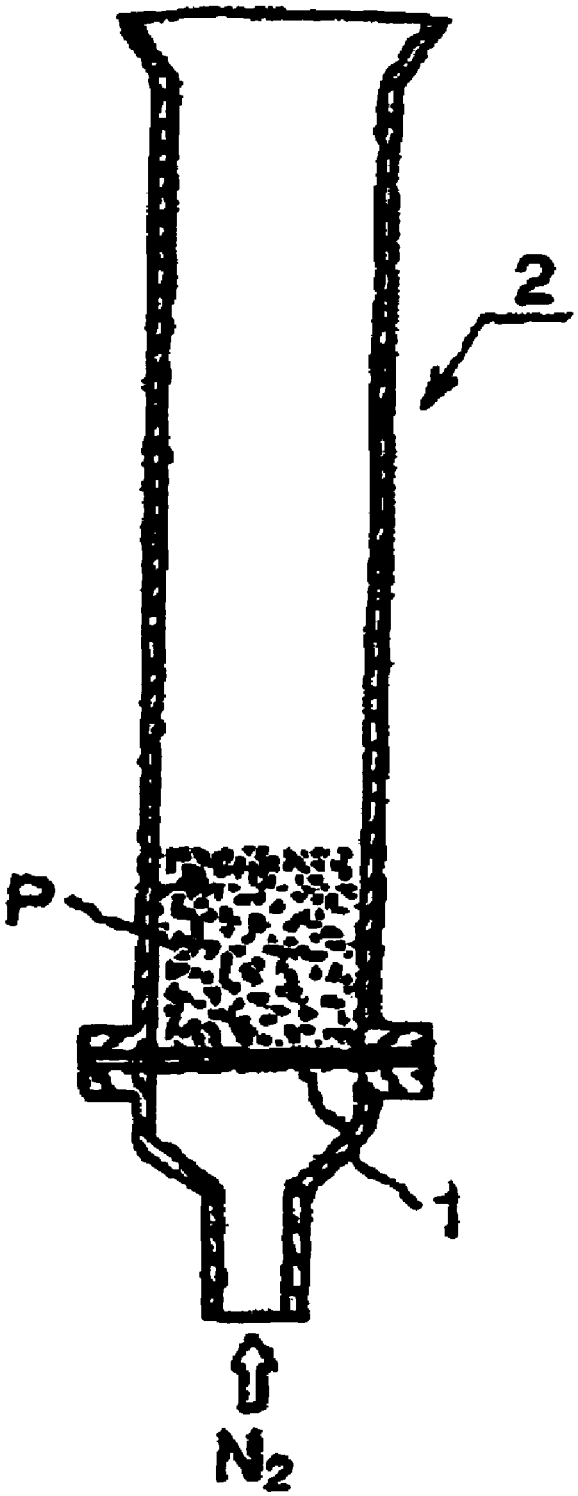
FIG. 1 is a schematic sectional view of a device used for measuring an amount of free carbon in example 1.

1: NEW MILLIPORE FILTER
2: FUNNEL-LIKE GLASS TUBE
P: MIXED POWDER

BEST MODE FOR CARRYING OUT THE INVENTION

The inventors have made intensive studies with paying attention in particular to carbon black, to provide a novel mixed powder for powder metallurgy which is capable of inhibiting a carbon supply component from generating dust and segregating without using a binder. As a result, it was found that when, as the carbon supply component, different from a conventional case where graphite powder is solely used, a predetermined mixture of graphite powder and carbon black is used, an intended object can be achieved. Accordingly, the invention has been completed.

In the followings, the invention will be explained in more detail.

In order to provide a mixed powder for powder metallurgy, which can be used without a binder, in particular, a mixed powder capable of producing a high density green compact, the inventors conducted studies with paying attention in particular to a carbon supply component.

Specifically, in the invention, as indexes of the mixed powder, (1) an amount of free carbon is 30% or less and (2) the density of a green compact when molding pressure is 490 MPa or more is 6.70 g/cm$^3$ or more are set.

The inventors at first conducted experiments with carbon black alone. As the result, it was found that, when carbon black was used in place of graphite powder, generally, an amount of free carbon (C-loss) in the mixed powder became less and the dust generation and segregation of the carbon supply component could be reduced. However, it was found from experiments by the inventors that, depending on the kind of the carbon black (dibutyl phthalate absorption, specific surface area, and particle diameter), it is sometimes difficult to uniformly mix the carbon black with an iron-base powder, that, in comparison with a case where the graphite powder was used, an extent of dust generation or segregation was raised and that, even by using a compacting and molding method, a green compact having sufficient strength could not be obtained.

In this connection, from a viewpoint of, irrespective of the kind of carbon black, providing a novel technology employing carbon black as a carbon supply component, the inventors further studied. As a result, it was found that, when, as the carbon supply component, carbon black was not solely used but used together with a graphite powder mixed at a predetermined ratio, irrespective of the kind of the carbon black, the characteristics (that can inhibit the carbon supply component from generating dust and segregating) necessary for the mixed powder could be provided. Furthermore, the inventors found that a mixed powder that is excellent as well in the characteristics (the density of the green compact and rattler value thereof) when it is pressure molded into a green compact and the characteristics (the density, radial crushing strength, and hardness) when it is sintered into a sintered body that is a final product could be provided. Accordingly, the inventors have achieved the invention.

A mechanism where a mixed powder for powder metallurgy having desired all characteristics can be obtained by using a graphite powder and carbon black together at a predetermined ratio as in the invention is not certain in detail. However, it is inferred as follows. When carbon black is mixed with a graphite powder, particles of carbon black can be inhibited from adhering and sticking with each other. Accordingly, it is considered that, irrespective of the kind of the carbon black, the carbon black can be uniformly mixed with an iron-base powder and whereby an extent of dust generation or segregation can be reduced. Furthermore, it is considered that when the carbon black is mixed with the graphite powder, particles of the carbon black are present so as to cover particles of the graphite powder and the carbon black having such a covering state sticks to an iron-base powder, and as a result, the graphite powder poor in the adhesiveness with the iron-base powder becomes applicable.

In the beginning, carbon black used in the invention will be described.

In general, carbon black is a fine powder made of about 95% or more of amorphous carbon and has the specific surface area reaching such a value as about 1000 m$^2$/g at the maximum. The carbon black exists as chain-like or cluster-like aggregates (called as a structure) where individual particles are fused to expand three-dimensionally.

The characteristics of the carbon black are mainly evaluated based on the particle morphology (such as particle diameter, specific surface area and the like), aggregate morphology of particles and physicochemical properties of a particle surface. In the invention, the characteristics are not restricted thereto and, within a range that does not damage the advantages of the invention, those within an appropriate range can be selected.

However, in order to further improve the characteristics necessary for the mixed powder, the carbon black preferably satisfies the following requirements.

In the beginning, the dibutyl phthalate (DBP) absorption which expresses the aggregation morphology of particles is preferably within the range of about 120 mL/100 g or less.

Here, the "DBP absorption" means an amount of DBP necessary for filling a gap of carbon black (that is, oil absorption at which carbon black absorbs the DBP that is a liquid).

The DBP absorption is known as being intimately related with the structure. For instance, in carbon black where primary particles of fine particles (substantially from several nanometers to twenty nanometers) are highly chained and aggregated, that is, the structure is highly developed, since a volume of a gap between particles is large, the DBP absorption becomes larger. On the other hand, in carbon black that has a structure where particle diameters of primary particles are large and the primary particles are present separately, that is, a structure that is not developed, a gap volume is small and the DBP absorption becomes smaller.

In the carbon black having large DBP absorption, since the structure has a highly developed aggregation structure, the density of the green compact is not so much increased, and therefore, the mechanical strength represented by the rattler value is assumed to be deteriorated as well.

The smaller the DBP absorption of carbon black is, the better. For instance, the DBP absorption is preferably 60 mL/100 g or less, more preferably 50 mL/100 g or less and still more preferably 40 mL/100 g or less. The lower limit thereof is not particularly restricted from the viewpoints of improving the density or the mechanical strength of the green compact. However, when the structure that the carbon black can form is taken into consideration, the DBP absorption is preferably 20 mL/100 g or more.

The DBP absorption of carbon black is measured based on JIS K6217-4 "Carbon Black for Rubber-Fundamental Characteristics-Part 4: Determination of DBP Absorption".

Furthermore, the nitrogen absorption specific surface area, which is a typical index of the specific surface area, is preferably about 150 $m^2/g$ or less.

Herein, the "nitrogen absorption specific surface area" is an amount corresponding to a total specific surface area including a pore portion on a surface of the carbon black.

When the nitrogen absorption specific surface area becomes larger, the density of the green compact cannot be so much increased and the rattler value becomes larger. Accordingly, there is a risk of becoming incapable of sufficiently obtaining the characteristics necessary for a sintered body.

The smaller the nitrogen absorption specific surface area of the carbon black is, the better. It is preferably, for instance, 50 $m^2/g$ or less, more preferably 40 $m^2/g$ or less and still more preferably 30 $m^2/g$ or less. The lower limit thereof is not particularly restricted from the viewpoints of improving the density or the mechanical strength of the green compact. However, taking the structure that the carbon black can form into consideration, the nitrogen absorption specific surface area is preferably 5 $m^2/g$ or more.

The nitrogen absorption specific surface area of carbon black is measured based on a method described in JIS K6217-2.

An average particle diameter of primary particles of carbon black is preferably 40 nm or more. When, in addition to the nitrogen absorption specific surface area, the average particle diameter of primary particles is further controlled to strictly control particle morphology of the carbon black, the characteristics of the green compact can be further improved, and whereby a sintered body further improved in the mechanical strength can be obtained. In the case that the average particle diameter of the primary particles is less than 40 nm, the carbon black, in a mixing step, tends to form a highly aggregated complicated structure, resulting in lowering the density of the green compact and the like. The larger the average particle diameter of primary particles is, the better. For instance, the average particle diameter of primary particles is preferably 70 nm or more. The upper limit thereof is not particularly restricted from the viewpoints of improving the density or the mechanical strength of the green compact. However, taking the structure that the carbon black can form into consideration, the average particle diameter of primary particles is preferably 1000 nm or less.

The average particle diameter of primary particles of the carbon black can be measured by the use of an electron microscope. Specifically, electron micrographs of several viewing fields are taken with an electron microscope at a magnification of several tens thousands times. Circle-approximated diameters of the projected respective particles are measured of about two thousands to ten thousands particles per one sample. The measurement can be carried out by the use of a particle diameter automatic analyzer (trade name: Zeiss Model TGA10) or the like.

The carbon purity of carbon black is not particularly restricted. However, since there is a possibility that atoms other than carbon atom (C) adversely affect on the characteristics of the sintered body, the carbon purity of the carbon black is preferably as high as possible. Specifically, a ratio of C in the carbon black is preferably 95% or more and more preferably 99% or more. As elements other than C, for instance, hydrogen (H) and an ash content (such as metal elements and inorganic elements) may be mentioned. As the ash content, for instance, salts and oxides of Mg, Ca, Si, Fe, Al, V, K, Na and the like can be mentioned and, among these, hydrogen (H) is preferably 0.5% or less. Furthermore, the ash content is preferably 0.5% or less and more preferably 0.1% or less in total.

A process of preparing carbon black satisfying such requirements is not particularly limited and can be appropriately selected from processes that are usually used. Specifically, for instance, an oil farness process, a thermal process (pyrolysis process) and the like may be mentioned. Among these, the second one, that is, the thermal process, has a feature that can readily control into a structure where an average particle diameter of primary particles is large and primary particles are independent, and therefore, it can be recommended as a process of preparing carbon black stipulated by the invention.

As the carbon black satisfying the above requirements, for instance, commercialized products can be used.

Furthermore, the inventors found that a mixed powder for powder metallurgy, in which a main component of a carbon supply component is carbon black having a dibutyl phthalate absorption of 60 mL/100 g or less and the nitrogen absorption specific surface area of 50 $m^2/g$ or less, could reduce an amount of free carbon of a mixed powder and was excellent in the characteristics (the density and rattler value of the green compact) when the mixed powder was pressure molded into a green compact. In this case, even when the carbon supply component is carbon black solely, excellent characteristics can be obtained. In this case, the carbon black is preferably contained in a proportion of 4.0 parts by weight or less with respect to 100 parts by weight of an iron-base powder that becomes a base material. As mentioned above, the carbon black works so as to heighten the density and strength of the green compact. However, when a content of the carbon black exceeds 4.0 parts by weight, the advantage may be conversely deteriorated. The lower limit of the content of carbon black is preferably set to be 0.1 parts by weight, whereby the advantages due to the carbon black can be effectively exerted. The content of the carbon black is more preferably 0.2 parts by weight or more and 2.0 parts by weight or less.

Still furthermore, a carburizing behavior of the carbon black to the iron-base powder during the sintering is same as that of the graphite powder, and the carbon black as well becomes a carbon supply source.

In the followings, a graphite powder used in invention will be described.

The graphite powder, so long as it is one that is usually used in a mixed powder for powder metallurgy, is not particularly restricted.

However, an average particle diameter of the graphite powder is preferably about 40 μm or less. This is because, when the average particle diameter exceeds 40 μm, there is a risk that it cannot react with an iron-base powder in the sintering process. The lower limit thereof is not particularly restricted. An average particle diameter of the graphite powder that is usually used is about in the range of 5 to 20 μm. In the invention, such graphite powder can be used as well.

As the graphite powder that satisfies the requirements, for instance, commercialized products can be used as well.

A mixing ratio of the carbon black and the graphite powder, as will be shown in examples described below, irrespective of the kind of the carbon black, is preferably set in the range of 15 parts by weight or more and 75 parts by weight or less of the carbon black with respect to 100 parts by weight in total of the carbon black and the graphite powder. That is, the mixing ratio of the graphite powder and carbon black is preferably in such a range that the ratio of graphite powder to carbon black is 25 to 85 parts by weight to 75 to 15 parts by weight. When the ratio of the carbon black is less than 15 parts by weight, an amount of free carbon (C-loss) becomes larger to increase the dust generation and segregation of the carbon supply component. On the other hand, when the ratio of the carbon black exceeds 75 parts by weight, an affect due to the kind of the carbon black becomes larger, that is, depending on selected carbon black, at the pressure forming, one that is brittle and difficult to retain a shape may be generated. Furthermore, in some cases, an intended density of the green compact may not be achieved. The ratio of the carbon black is preferably 20 parts by weight or more and 60 parts by weight or less, and more preferably 20 parts by weight or more and 50 parts by weight or less.

Specifically, the mixing ratio of the carbon black, as will be shown in examples described below, is preferred to appropriately vary in accordance with the ranges of the DBP absorption and nitrogen absorption specific surface area of the carbon black. Accordingly, a desired mixed powder (30% or less in the amount of free carbon and 6.70 g/cm$^3$ or more in the density of the green compact) can be obtained.

The mixed powder for powder metallurgy of the invention contains foregoing carbon supply component and iron-base powder.

The iron-base powder used in the invention includes both of a pure iron powder and an iron alloy powder. These may be used singularly or in combination thereof.

Among these, the pure iron powder is an iron powder that contains 97% or more of an iron powder and a balance of inevitable impurities (such as oxygen, silicon, carbon, manganese and the like), and can be presumed as a substantially pure iron component.

Furthermore, the iron alloy powder contains, in order to improve the characteristics of a sintered body, as a component other than an iron component, alloy components such as copper, nickel, chromium, molybdenum, sulfur, manganese and the like. The iron alloy powder can be roughly divided into a diffusion type iron powder (one obtained by diffusion bonding of an alloy element to an iron-base powder, that is, partially alloyed powder) and a pre-alloyed type iron powder (one produced by adding an alloy element in a melting process, that is, prealloyed powder). In the invention, these can be preferably used singularly or in a combination thereof.

The mixed powder of the invention may be constituted of the carbon supply component and the iron-base powder. However, in order to improve the characteristics and the like of the sintered body, a physical property-improving component may be further added.

As the physical property-improving component, for instance, metal powders and inorganic powders may be mentioned. These may be used singularly or in a combination of at least two kinds.

Among these, as the metal powder, for instance, copper, nickel, chromium, molybdenum, tin, vanadium, manganese, ferrophosphorus and the like may be mentioned. These may be used singularly or in a combination of at least two kinds. In particular, when a pure iron powder is used as an iron-base powder, foregoing metal powders can be preferably added. The metal powder may be a ferroalloy that is an alloy with iron or an alloy powder made of at least two kinds other than iron.

As the inorganic powder, for instance, sulfides such as manganese sulfide and manganese dioxide; nitrides such as boron nitride; oxides such as boric acid, magnesium oxide, potassium oxide and silicon oxide; phosphorus; sulfur; and the like may be mentioned. These may be used singularly or in a combination of at least two kinds thereof.

A content of the physical property-improving component is not limited so long as the advantages of the invention is not inhibited, and it can be arbitrarily determined corresponding to various characteristics required for a final product. It is preferably 0.01 parts by weight or more and 10 parts by weight or less in total with respect to 100 parts by weight of the iron-base powder.

For instance, when a pure iron powder is used as the iron-base powder, preferable contents of the powders below are respectively as follows. That is, 0.1 to 10 parts by weight of copper, 0.1 to 10 parts by weight of nickel, 0.1 to 8 parts by weight of chromium, 0.1 to 5 parts by weight of molybdenum, 0.01 to 3 parts by weight of phosphorus and 0.01 to 2 parts by weight of sulfur.

The mixed powder of the invention may further contain a lubricant within a range that it does not adversely affect on the advantages of the invention. The lubricant reduces the friction coefficient between a green compact and a mold during the green compact is formed by the pressure forming and whereby suppresses the mold from being galled or damaged.

The lubricant used in the invention is not particularly restricted so long as it is usually used for the mixed powder for powder metallurgy. For instance, ethylene bisstearylamide, stearic acid amide, zinc stearate, lithium stearate and the like may be mentioned. These may be used singularly or in a combination of at least two kinds thereof.

The lubricant is preferably used in the range of 0.01 to 1.5 parts by weight with respect to 100 parts by weight of the iron-base powder. When the content of the lubricant is less than 0.01 parts by weight, the advantage obtained by adding the lubricant cannot be sufficiently exerted. On the other hand, when the content of the lubricant exceeds 1.5 parts by weight, the compressibility of a green compact may be deteriorated. The content of the lubricant is 0.1 to 1.2 parts by weight and still more preferably 0.2 to 1.0 parts by weight.

In the invention, a binder usually added to the mixed powder for powder metallurgy can be omitted. This is because, as mentioned above, in the invention, a predetermined mixture of the graphite powder and carbon black or predetermined carbon black is used as a carbon supply component, and, whereby, without using a binder, the carbon supply component can be sufficiently inhibited from spattering or segregating (refer to examples described below). In this regard, however, within a range that the advantages of the invention are not impaired (in particular, the fluidity of the mixed powder), a binder that is so far generally used may be used. The binder is added not from the viewpoint of inhibiting the carbon supply component from segregating but from the viewpoint of inhibiting powders such as Ni powder or Cu powder that is free from the self-adhesiveness from segregating. Additionally, binders described in JP-A-2003-105405, JP-A-2004-256899, JP-A-2004-360008 and the like may be used as well.

In the followings, a process for preparing a mixed powder, a green compact and a sintered body by using with foregoing components will be described.

The mixed powder of the invention is obtainable by mixing the carbon supply component stipulated in the invention (predetermined mixture of a graphite powder and carbon black, or predetermined carbon black) and an iron-base powder. According to the necessity, the physical property-improving component may be added and also a lubricant and a binder may be added.

Morphologies of the carbon black and the graphite powder when these are mixed with the iron-base powder are not particularly restricted.

For instance, the carbon black may be mixed with the iron-base powder in powder morphology. Additionally, a dispersion liquid where the carbon black is dispersed in a dispersion medium may be mixed with the iron-base powder. In the latter case, after mixing, the dispersion medium is preferably removed by heating or the like.

A mixing method is not particularly restricted. A mixer such as a mixer with blade, a V-blender or a double-cone type mixer (W-cone), which is usually used, can be used. The mixing conditions are, when for instance a mixer with blade is used, preferably controlled so that a rotation speed of the blade (peripheral speed of the blade) is in the range of about 2 to 10 m/s and a mixing time may be in the range of about 0.5 to 20 min. Furthermore, when a V blender or double-cone type mixer is used, the mixing conditions are preferably controlled in the range of 2 to 50 rpm for 1 to 60 min.

Then, with the mixed powder, a green compact is obtained according to an ordinary pressure forming method by use of a powder compression molding machine. Specific forming conditions are, though different depending on kinds and addition amounts of components that constitute the mixed powder, a shape of the green compact, a forming temperature (substantially from room temperature to 150° C.), forming pressure and the like, preferably set so that the density of the green compact may be in the range of about 6.0 to 7.5 g/cm$^3$.

Finally, the green compact is sintered according to an ordinary sintering process to obtain a sintered body. Specific sintering conditions are different depending on kinds and addition amounts of components that constitute the green compact, a kind of a final product and the like. However, the green compact is preferably sintered, for instance, under an atmosphere of $N_2$, $N_2$—$H_2$, hydrocarbon or the like, at a temperature in the range of 1000 to 1300° C. for 5 to 60 min.

EXAMPLES

In the followings, the invention will be more specifically described with reference to examples. However, the invention, without restricting to the examples below, can be carried out appropriately modified within a range that can adapt to gist described above and below, and all these are included in a technical range of the invention. In this regard, unless particularly stated, "%" in the following examples below means "% by weight".

Example 1

Discussion of Characteristics of Mixed Powder and Green Compact

In this example, the characteristics of mixed powders and green compacts in which various kinds of carbon blacks and graphite powders are used as carbon supply components are discussed.

Specifically, with carbon blacks (commercialized products) of a through c shown in Table 1 and graphite powders of X through Z (commercialized products) described in Table 2, mixed powders for powder metallurgy and green compacts (experiments 1 through 24) were obtained as shown below. In Tables 1 and 2, numerical values described in catalogues of the commercialized products are transcribed.

The characteristics of mixed powders and green compacts obtained by the respective experiments were measured according to methods below and evaluated.

(Characteristics of Mixed Powders)

1. Test Method of Apparent Density of Metal Powder

Based on "Determination of Apparent Density" JIS Z2504, the apparent densities (g/cm$^3$) of the mixed powders were measured.

2. Test Method of Fluidity of Metal Powder

Based on "Determination of Fluidity" JIS Z2502, times (sec/50 g) during which the mixed powder (50 g) flows out of an orifice of 2.63 mmϕ were measured.

3. Amount of Free-Carbon (Dust Generation Rate, C-Loss)

As shown in FIG. 1, a mixed powder P (25 g) was poured in a funnel-like glass tube 2 (inner diameter: 16 mm and height: 106 mm) attached with a new Millipore filter 1 (mesh: 12 μm), a $N_2$ gas was flowed from a lower portion of the glass tube 2 at a velocity of 0.8 l/min for 20 min, and the amount of free carbon (%) was obtained from an equation below. In the example, ones of which amount of free carbon is 30% or less were judged as acceptable.

Amount of free carbon (%)=[1−(amount of carbon after $N_2$ gas is flowed (%))/(amount of carbon before $N_2$ gas flow is flowed (%))]×100

Here, the amount of carbon (%) means weight percent of carbon in the mixed powder.

(Characteristics of Green Compact)

1. Measurement of Density

In order to measure the density of a green compact, based on Japan Society of Powder and Powder Metallurgy (JSPM) standard 1-64 (Test Method of Compressibility of Metal Powder), a cylindrical green compact having a diameter of 11.3 mm and a height of 10 mm was prepared. The forming pressure was set at 490 MPa. A weight of an obtained green compact was measured, followed by diving by a volume, and an obtained value (g/cm$^3$) was taken as the density of the green compact. In the example, the green compacts of which density is 6.70 g/cm$^3$ or more were judged as acceptable.

2. Measurement of Rattler Value

Based on Japan Powder Metallurgy Association (JPMA) Standard 011-1192 (Method of Measurement of Rattler Value of Metal Green Compact), a rattler value (%) of a green compact was measured.

Experiment 1

In the beginning, as an iron-base powder, commercially available pure iron powder (trade name: Atomel 300M, produced by Kobe Steel, Ltd.) was prepared. To the pure iron powder, 2.0% of commercially available atomized copper powder (average particle diameter: 48 μm), 0.80% of a carbon supply component [in more detail, 0.004% of carbon black a described Table 1 and 0.796% of graphite powder X described in Table 2 (carbon black:graphite powder=0.5 parts by weight:99.5 parts by weight)] and 0.75% of ethylenebisstearylamide as a lubricant were added, followed by mixing by use of a V-blender at a rotation speed of 30 rpm for 30 min, and thereby a mixed powder was obtained. Here, a binder was not used.

Next, the mixed powder was put in a powder compression molding machine, followed by applying the compression molding under pressure of 490 MPa, thereby a cylindrical green compact having an outer diameter of 11.3 mm and a height of 10 mm was obtained.

Experiments 2 Through 7

Except that, in experiment 1, mixing ratios of the carbon black a and graphite powder X were respectively varied as shown in Table 3, mixed powders and green compacts of experiments 2 through 7 were respectively prepared similarly to experiment 1.

Experiment 8

Except that, in experiment 1, the graphite powder X was not used and an amount of the carbon black a of Table 1 was set at 0.80%, a mixed powder and a green compact of experiment 8 were prepared similarly to experiment 1.

Experiments 9 Through 13

Except that, in experiment 1, carbon black b of Table 1 was used in place of the carbon black a and a mixing ratio of the carbon black b and the graphite powder X was varied as shown in Table 3, mixed powders and green compacts of experiments 9 through 13 were respectively prepared similarly to experiment 1.

Experiment 14

Except that, in experiment 1, the graphite powder X was not used and 0.80% of carbon black b shown in Table 1 was used, a mixed powder and a green compact of experiment 14 were prepared similarly to experiment 1.

Experiments 15 Through 18

Except that, in experiment 1, carbon black c of Table 1 was used in place of the carbon black a and a mixing ratio of the carbon black c and the graphite powder X was varied as described in Table 3, mixed powders and green compacts of experiments 15 through 18 were respectively prepared similarly to experiment 1.

Experiment 19

Except that, in experiment 1, the graphite powder X was not used and 0.80% of carbon black c shown in Table 1 was used, a mixed powder and a green compact of experiment 19 were prepared similarly to experiment 1.

Experiment 20

Except that, in experiment 1, the carbon black was not used and 0.80% of graphite powder X shown in Table 2 was used, a mixed powder and a green compact of experiment 20 were prepared similarly to experiment 1.

Experiment 21

Except that, in experiment 5, graphite powder Y was used in place of the graphite powder X, a mixed powder and a green compact of experiment 21 were prepared similarly to experiment 5.

Experiment 22

Except that, in experiment 20, 0.80% of graphite powder Y of Table 2 was used in place of the graphite powder X, a mixed powder and a green compact of experiment 22 were prepared similarly to experiment 20.

Experiment 23

Except that, in experiment 5, graphite powder Z was used in place of the graphite powder X, a mixed powder and a green compact of experiment 23 were prepared similarly to experiment 5.

Experiment 24

Except that, in experiment 20, 0.80% of graphite powder Z of Table 2 was used in place of the graphite powder X, a mixed powder and a green compact of experiment 24 were prepared similarly to experiment 20.

The results are shown in Table 3. For reference purpose, a column of overall evaluation is disposed in Table 3 and mixed powders satisfying acceptable levels of the invention (amount of free carbon: 30% or less and the density when formed into a green compact under forming pressure of 490 MPa: 6.70 g/cm$^3$ or more) are shown with an A mark and ones that do not satisfy at least one of acceptable criteria are shown with a mark B.

TABLE 1

| Symbol | Maker | DBP Absorption (mL/100 g) | Nitrogen Absorption Specific Surface Area (m$^2$/g) | Average Particle Diameter of Primary Particles (nm) | Producing Method | Remarks |
|---|---|---|---|---|---|---|
| a | Company A | 38 | 8 | 300 | Thermal Method | Volatile Portion: <1%, Ash Content: 0.3% |
| b | Company B | 113 | 130 | 10 | Oil Furnace Method | Relative Coloring Power: 124%, Ash Content: 0.5% |

TABLE 1-continued

| Symbol | Maker | DBP Absorption (mL/100 g) | Nitrogen Absorption Specific Surface Area ($m^2/g$) | Average Particle Diameter of Primary Particles (nm) | Producing Method | Remarks |
|---|---|---|---|---|---|---|
| c | Company C | 22 | 24 | 80 | Oil Furnace Method | Relative Coloring Power: 52%, Volatile Portions: 0.50%, pH: 7.5 |

TABLE 2

| Symbol | Maker | Purity (%) | Ash Content (%) | Average Particle Diameter (μm) | Kind |
|---|---|---|---|---|---|
| X | Company C | 97 | 2 | 5 | Natural Graphite |
| Y | Company D | 95 | 5 | 11 | Natural Graphite |
| Z | Company E | 95 | 4 | 8 | Natural Graphite |

When the graphite powder X alone was used as the carbon supply component, as shown in experiment 20, although a high density green compact could be obtained, an amount of free carbon in the mixed powder increased. Furthermore, also in the experiment 1 where a ratio of the carbon black a is small, an amount of the free carbon became increased.

On the other hand, in experiments 2 through 5, both the amounts of free carbon and densities of the green compacts are in an excellent range. In particular, in the experiments 2 through 5 where the mixing ratios of the carbon black a and graphite powder X satisfy the preferable range of the invention (the ratio of carbon black: 15 to 75 parts by weight), as shown in Table 3, excellent mixed powders could be obtained.

TABLE 3

| | Carbon Supply Component (Mixing Ratio) | | | | Characteristics | | | | | |
|---|---|---|---|---|---|---|---|---|---|---|
| | | | | | Mixed Powder | | | Green Compact | | |
| | Carbon Black | | Graphite Powder | | | | | | | |
| Experiment | Symbol | Ratio (parts) | Symbol | Ratio (parts) | Apparent Density ($g/cm^3$) | Fluidity (sec/50 g) | Amount of Free Carbon (%) | Density ($g/cm^3$)* | Rattler Value (MPa)* | Overall Evaluation |
| 1 | a | 0.5 | X | 99.5 | 3.13 | 28.5 | 40 | 6.91 | 0.85 | B |
| 2 | | 15 | | 85 | 3.13 | 28.0 | 28 | 6.90 | 0.86 | A |
| 3 | | 20 | | 80 | 3.13 | 27.5 | 21 | 6.89 | 0.88 | A |
| 4 | | 40 | | 60 | 3.12 | 25.4 | 11 | 6.88 | 0.85 | A |
| 5 | | 60 | | 40 | 3.12 | 23.9 | 4 | 6.85 | 0.96 | A |
| 6 | | 80 | | 20 | 3.14 | 23.6 | 4 | 6.81 | 1.12 | A |
| 7 | | 90 | | 10 | 3.14 | 22.3 | 4 | 6.80 | 1.15 | A |
| 8 | | 100 | | 0 | 3.13 | 21.8 | 4 | 6.79 | 1.12 | A |
| 9 | b | 10 | X | 90 | 2.98 | 26.5 | 40 | 6.87 | 0.75 | B |
| 10 | | 15 | | 85 | 2.92 | 24.5 | 30 | 6.85 | 0.73 | A |
| 11 | | 20 | | 80 | 2.91 | 23.9 | 20 | 6.84 | 0.72 | A |
| 12 | | 50 | | 50 | 3.05 | 23.0 | 10 | 6.80 | 1.02 | A |
| 13 | | 80 | | 20 | 3.09 | 21.7 | 6 | 6.68 | 1.98 | B |
| 14 | | 100 | | 0 | 3.02 | 23.0 | 8 | 6.53 | 100.0 | B |
| 15 | c | 10 | X | 90 | 3.02 | 32.3 | 40 | 6.86 | 0.94 | B |
| 16 | | 20 | | 80 | 3.02 | 30.6 | 27 | 6.85 | 0.96 | A |
| 17 | | 60 | | 40 | 3.00 | 27.0 | 5 | 6.80 | 0.98 | A |
| 18 | | 80 | | 20 | 3.04 | 26.6 | 6 | 6.76 | 1.17 | A |
| 19 | | 100 | | 0 | 3.11 | 22.6 | 2 | 6.76 | 1.16 | A |
| 20 | — | 0 | X | 100 | 3.13 | 28.8 | 45 | 6.92 | 0.84 | B |
| 21 | a | 60 | Y | 40 | 3.13 | 25.0 | 12 | 6.81 | 1.06 | A |
| 22 | — | 0 | | 100 | 3.08 | 29.6 | 63 | 6.89 | 0.91 | B |
| 23 | a | 60 | Z | 40 | 3.12 | 27.5 | 11 | 6.88 | 0.91 | A |
| 24 | — | 0 | | 100 | 3.08 | 29.2 | 53 | 6.92 | 0.81 | B |

*Forming pressure: 490 MPa
Note:
Underlined portions do not satisfy a requirement of the invention.

From Table 3, considerations can be done as shown below.

(With Regard to Carbon Black a)

Firstly, the results (experiment 1 through 8 and 20) obtained when carbon black a (DBP absorption: 38 ml/100 g and nitrogen absorption specific surface area: 8 $m^2/g$) and graphite powder X are used as the carbon supply component and a mixing ratio thereof is varied are considered.

In the above, the results obtained when the carbon black a and graphite powder X were used are described. However, also when graphite powder Y was used in place of the graphite powder X (experiments 21 and 22) or graphite powder Z was used in place of the graphite powder X (experiments 23 and 24), similar results as the above were obtained. In Table 3, only the results obtained when the ratio of the carbon black a was set at 60 parts by weight (experiments 21 and 23) are shown. However, it is confirmed from the experiments that also when the ratio of the carbon black a was variously varied like in experiments 1 through 7, similar experimental results as the above could be obtained (not shown in Table 3).

Furthermore, it is confirmed that the series of results have the same tendency not only when the carbon black a is used but also when carbon black belonging to carbon black A group is used (not shown in Table 3).

(With Regard to Carbon Black b)

Next, the results (experiment 9 through 14 and 20) obtained when carbon black b (DBP absorption: 113 ml/100 g and nitrogen absorption specific surface area: 130 $m^2/g$) and graphite powder X are used as the carbon supply component and a mixing ratio thereof is varied are considered.

When the graphite powder alone X was used as the carbon supply component, as shown in experiment 20, although a high density green compact could be obtained, an amount of free carbon in the mixed powder became increased. On the other hand, when the carbon black b was used alone, as shown in experiment 14, although an amount of free carbon in the mixed powder was less, the density of a green compact was lowered.

On the other hand, in experiments 10 through 12 where the mixing ratios of the carbon black b and graphite powder X satisfy a preferable range of the invention (ratio of carbon black: 15 to 75 parts by weight), as shown in Table 3, intended mixed powders were obtained. Experiment 9 is an example where the ratio of carbon black b is small and showed an increase in an amount of free carbon. Furthermore, experiment 13 is an example where the ratio of carbon black b is large and showed a decrease in the density of the green compact.

In the above, the results obtained when the carbon black b and graphite powder X were used are shown. However, it is confirmed from the experiments that also when graphite powder Y or Z was used in place of the graphite powder X, results same as the above were obtained (not shown in Table 3).

Furthermore, it is confirmed from the experiments that the series of results have the same tendency not only when the carbon black b was used but also when carbon black belonging to carbon black B group was used (not shown in Table 3).

(With Regard to Carbon Black c)

Next, the results (experiment 15 through 20) obtained when carbon black c (DBP absorption: 22 ml/100 g and nitrogen absorption specific surface area: 80 $m^2/g$) and graphite powder X are used as the carbon supply component and a mixing ratio thereof is varied are considered.

When the graphite powder X alone was used as the carbon supply component, as shown in experiment 20, although a high density green compact could be obtained, an amount of free carbon in the mixed powder became increased.

On the other hand, experiments 16 through 19 have both the amount of free carbon and the density of green compact in excellent ranges. In particular, in experiments 16 and 17 where the mixing ratio of the carbon black c and graphite powder X satisfies an excellent range of the invention (ratio of carbon black: 15 to 75 parts by weight), as shown in Table 3, intended mixed powders were obtained. Experiment 15 is an example where the ratio of the carbon black c is small and an amount of free carbon became large.

In the above, the results obtained when the carbon black c and graphite powder X were used are shown. However, it is confirmed from the experiments that also when graphite powder Y or Z was used in place of the graphite powder X, results same as the above were obtained (not shown in Table 3).

Furthermore, it is confirmed from the experiments that the series of results have the same tendency not only when the carbon black c was used but also when carbon black belonging to carbon black C group was used (not shown in Table 3).

Example 2

Discussion on Characteristics of Sintered Body

In this example, the characteristics of sintered bodies of the example 1 in which a mixture of carbon black and graphite powder are used as the carbon supply component are discussed with comparing with that of the case in which graphite powder is used. Here, the density of the sintered body was set at 6.80 $g/cm^3$.

Specifically, each of the mixed powders of experiments 3 through 8 (carbon black a was used), experiments 11 and 13 (carbon black b was used) and experiments 16, 18 and 19 (carbon black c was used) of the example 1 and experiments 20, 22 and 24 (only graphite powder was used without adding carbon black) of conventional examples was put into a powder compression molding machine, followed by compression molding under pressure of 400 to 600 MPa, whereby ring-shaped green compacts having an outer diameter of 30 mm, an inner diameter of 10 mm and a height of 10 mm were obtained.

The green compacts were sintered at 1120° C. for 20 min under a gas atmosphere of $N_2$-10% by volume $H_2$ gas by the use of a pusher sintering furnace, and then sintered bodies (density: 6.80 $g/cm^3$) were obtained.

The radial crushing strength and hardness of thus obtained sintered body were measured and evaluated as follows.

(Characteristics of Sintered Body)

1. Determination of Radial Crushing Strength

A radial crushing strength test described in JIS Z2507 was carried out to determine the radial crushing strength ($N/mm^2$).

2. Determination of Hardness

Based on a test method of Rockwell Hardness Test of JIS Z2245, the Rockwell hardness (HRB) was measured.

The results are shown in Table 4.

TABLE 4

| | | Carbon supply component (Mixing ratio) | | | | Characteristics of sintered body (Density of sintered body = 6.80 $g/cm^3$) | |
|---|---|---|---|---|---|---|---|
| | | Carbon black | | Graphite powder | | | |
| No. | No. in Table 3 | Symbol | Ratio (parts) | Symbol | Ratio (parts) | Crushing strength ($N/mm^2$) | Hardness (HRB) |
| 1 | 3 | a | 20 | X | 80 | 815.9 | 76.4 |
| 2 | 4 | | 40 | | 60 | 814.9 | 76.3 |
| 3 | 5 | | 60 | | 40 | 815.0 | 75.9 |
| 4 | 6 | | 80 | | 20 | 813.4 | 76.0 |
| 5 | 8 | | 100 | | 0 | 813.9 | 76.1 |
| 6 | 11 | b | 20 | X | 80 | 810.4 | 75.6 |
| 7 | 13 | | 80 | | 20 | 806.8 | 75.6 |
| 8 | 16 | c | 20 | X | 80 | 814.2 | 76.3 |
| 9 | 18 | | 80 | | 20 | 811.4 | 76.1 |
| 10 | 19 | | 100 | | 0 | 811.1 | 76.0 |
| 11 | 20 | — | 0 | X | 100 | 816.3 | 76.3 |
| 12 | 21 | a | 60 | Y | 40 | 789.4 | 74.2 |
| 13 | 22 | — | 0 | | 100 | 796.3 | 74.7 |

TABLE 4-continued

| | | Carbon supply component (Mixing ratio) | | | | Characteristics of sintered body (Density of sintered body = 6.80 g/cm$^3$) | |
|---|---|---|---|---|---|---|---|
| | | Carbon black | | Graphite powder | | | |
| No. | No. in Table 3 | Symbol | Ratio (parts) | Symbol | Ratio (parts) | Crushing strength (N/mm$^2$) | Hardness (HRB) |
| 14 | 23 | a | 60 | Z | 40 | 801.4 | 75.5 |
| 15 | 24 | — | 0 | | 100 | 811.4 | 75.7 |

From Table 4, the followings can be considered.

According to the comparison between the characteristics in the case that the sintering density is 6.80 g/cm$^3$ in Table 4, it was found that, whatever carbon black of carbon blacks a through c was used, when the carbon black and graphite powder were mixed and used, irrespective of the mixing ratio of the carbon black, the mechanical characteristics (radial crushing strength and hardness) substantially same as that in the case of using the graphite powder alone could be obtained. Furthermore, as the result of observation of microstructure of the sintered bodies, a pearlite structure was observed in all samples. This shows that the carbon black was carburized in the iron-base powder, similarly to the graphite.

In Table 4, results of a part of the experimental examples shown in Table 3 are shown. However, it is confirmed from the experiments that even in other experiments shown in Table 3, experimental results same as the above can be obtained (not shown in Table 4).

Furthermore, it is confirmed from the experiments that the series of results have the same tendency not only when the carbon black a, b or c was used but also when carbon black belonging to carbon black A, B or C group was used (not shown in Table 4).

Example 3

Discussion on Characteristics of Mixed Powder and Green Compact

In this example, the characteristics of mixed powders and green compacts in which various carbon blacks are used are discussed.

Specifically, with carbon blacks (commercialized products) of d through o shown in Table 5, as shown below, mixed powders for powder metallurgy and green compacts were obtained (experiments 25 through 36). Among these carbon blacks, carbon blacks d through i are examples that satisfy the inventive requirements and carbon blacks j through o are examples that do not satisfy the inventive requirements. In Table 5, numerical values described in catalogues of the commercialized products are transcribed. Furthermore, for the purpose of comparison, a mixed powder for powder metallurgy and a green compact were obtained by using graphite powder in place of the carbon black (experiment 37).

The characteristics of the mixed powders and green compacts obtained in the respective experiments were measured according to methods described in example 1 and evaluated.

Experiment 25

In the beginning, as an iron-base powder, commercialized pure iron powder (trade name: Atomel 300M, produced by Kobe Steel, Ltd.) was prepared. To the pure iron powder, 2.0% of commercialized atomized copper powder (average particle diameter: 48 μm), 0.80% of carbon black a described in Table 4 as a carbon supply component and 0.75% of ethylenebisstearylamide as a lubricant were added, followed by agitating at high-speed (rotation speed of the blade: 5 m/s) by the use of a mixer with blade for 2 min, and whereby a mixed powder was obtained. Here, a binder was not used.

Next, the mixed powder was put in a powder compression molding machine, followed by applying the compression molding under pressure of 490 MPa, whereby a cylindrical green compact having an outer diameter of 11.3 mm and a height of 10 mm was obtained.

(Experiments 26 Through 36)

Except that, in experiment 25, carbon blacks d through o shown in Table 5 were used as the carbon supply component, mixed powders and green compacts of experiments 26 through 36 were respectively prepared similarly to experiment 25.

(Experiment 37)

Except that, in experiment 25, a commercialized graphite powder (average particle diameter: 5 μm) was used as the carbon supply component in place of the carbon black, a mixed powder and green compact were prepared similarly to experiment 25.

The results are shown in Table 6. In Table 6, for the purpose of comparison, the kind and characteristics of carbon supply components used are shown together.

TABLE 5

| Mark | Maker | DBP absorption (ml/100 g) | Nitrogen absorption specific surface area (m$^2$/g) | Average particle diameter of primary particles (nm) | Producing method | Remark |
|---|---|---|---|---|---|---|
| d | A Company | 38 | 8 | 300 | Thermal process | Volatile portions <1%, ash content: 0.3% |
| e | B Company | 22 | 24 | 80 | Oil furnace process | Relative coloring power: 52%, volatile portions: 0.50%, pH: 7.5 |
| f | B Company | 49 | 24 | 78 | Oil furnace process | Relative coloring power: 48%, volatile portions: 0.70%, pH: 7.5 |
| g | C Company | 44 | 9.5 | 250 | Thermal process | Volatile portions: 0.10%, ash content: 0.2%, pH: 10.0 |

TABLE 5-continued

| Mark | Maker | DBP absorption (ml/100 g) | Nitrogen absorption specific surface area ($m^2/g$) | Average particle diameter of primary particles (nm) | Producing method | Remark |
|---|---|---|---|---|---|---|
| h | D Company | 51 | 23 | 95 | Oil furnace process | Relative coloring power: 40%, ash content: 0.10%, apparent density: 570 g/L |
| i | D Company | 60 | 27 | 70 | Oil furnace process | Volatile portions: 0.12%, ash content: 0.02% |
| j | A Company | 113 | 130 | 10 | Oil furnace process | Relative coloring power: 124%, ash content: 0.5% |
| k | B Company | 61 | 140 | 20 | Oil furnace process | Relative coloring power: 140%, pH: 7.5, volatile portions: 1.50% |
| l | E Company | 72 | 25 | 75 | Oil furnace process | Relative coloring power: 58%, volatile portions: 0.50%, apparent density: 270 g/L |
| m | E Company | 46 | 55 | 34 | Oil furnace process | Relative coloring power: 101%, volatile portions: 1.00%, apparent density: 310 g/L |
| n | F Company | 360 | 800 | 39.5 | Oil furnace process | Volatile portions: 0.40%, ash content: 0.02%, pH: 9.0 |
| o | F Company | 495 | 1400 | 34 | Oil furnace process | Volatile portions: 0.50%, ash content: 0.02%, pH: 9.0 |

TABLE 6

| | Carbon supply component Carbon black | | | | Characteristics | | | | |
|---|---|---|---|---|---|---|---|---|---|
| | | | | | Mixed powder | | | Green compact | |
| Experiment | Symbol | DBP absorption (mL/100 g) | Nitrogen absorption specific surface area ($m^2/g$) | Average particle diameter of primary particles (nm) | Apparent density ($g/cm^3$) | Fluidity (sec/50 g) | Amount of free carbon (%) | Density ($g/cm^3$)* | Rattler value (%)* |
| 25 | d | 38 | 8 | 300 | 3.13 | 21.8 | 4 | 6.79 | 1.12 |
| 26 | e | 22 | 24 | 80 | 3.11 | 22.6 | 2 | 6.76 | 1.16 |
| 27 | f | 49 | 24 | 78 | 3.27 | 20.7 | 3 | 6.70 | 1.68 |
| 28 | g | 44 | 9.5 | 250 | 3.15 | 23.2 | 1 | 6.76 | 1.51 |
| 29 | h | 51 | 23 | 95 | 3.20 | 22.5 | 2 | 6.74 | 1.63 |
| 30 | i | 60 | 27 | 70 | 3.22 | 21.6 | 3 | 6.71 | 1.74 |
| 31 | j | 113 | 130 | 10 | 3.02 | 23.0 | 8 | 6.53 | 100.0 |
| 32 | k | 61 | 140 | 20 | 2.92 | 27.2 | 0 | 6.68 | 2.37 |
| 33 | l | 72 | 25 | 75 | 3.28 | 22.1 | 3 | 6.64 | 3.07 |
| 34 | m | 46 | 55 | 34 | 2.99 | 23.0 | 7 | 6.65 | 2.62 |
| 35 | n | 360 | 800 | 39.5 | 2.54 | 39.2 | 64 | 6.07 | 100.0 |
| 36 | o | 495 | 1400 | 34 | 2.52 | 37.6 | 70 | 5.97 | 100.0 |
| 37 | Graphite | | | 5000 | 3.13 | 28.8 | 45 | 6.92 | 0.84 |

*Forming pressure: 490 MPa
Note:
Underlined portions do not satisfy the inventive requirements.

From Table 6, the followings can be considered.

Experiments 25 through 30 are inventive examples where carbon blacks d through i that satisfy the requirements of the invention are used, and they are excellent not only in the respective characteristics of the mixed powders but also in the characteristics of the green compacts.

On the other hand, experiments 31 through 36 are comparative examples where carbon blacks that do not satisfy the inventive requirements are used. In these experiments, the amounts of free carbon of the mixed powders and the densities and rattler values of the green compacts do not reach standard values speculated in the invention.

In experiments 35 and 36, the amounts of free carbon in the mixed powders increase and the fluidities are deteriorated. This is considered that, since carbon blacks n and o having extremely large DBP absorption and nitrogen absorption specific surface area are used, before the carbon black is mixed with (adhered to) the iron-base powder in the mixing step, the carbon black forms a large structure.

Experiment 37 is a conventional example where graphite powder was used solely as the carbon supply component. The amount of free carbon was increased.

Example 4

Discussion on Characteristics of Sintered Body

In this example, the characteristics of sintered bodies in which carbon blacks satisfying the inventive requirements are used are discussed with comparing with that of a sintered body in which graphite powder is used. Here, the density of the sintered body was set at 6.80 g/cm$^3$.

Specifically, each of the mixed powders of the experiments 25 through 30 (carbon blacks d through i of Table 5 were used) and experiment 38 (graphite powder was used) was put into a powder compression molding machine and compression molded under pressure of 400 to 600 MPa, and whereby a ring-shaped green compact having an outer diameter of 30 mm, an inner diameter of 10 mm and a height of 10 mm was obtained.

The green compacts were sintered at 1120° C. for 20 min under a gas atmosphere of $N_2$-10% by volume $H_2$ gas by the use of a pusher sintering furnace, and then sintered bodies (density: 6.80 g/cm$^3$) were obtained.

The radial crushing strength and hardness of thus obtained sintered bodies were measured and evaluated as follows.

(Characteristics of Sintered Body)

1. Determination of Radial Crushing Strength

A radial crushing strength test described in JIS Z2507 was carried out to determine the radial crushing strength (N/mm$^2$).

2. Determination of Hardness

Based on a test method of Rockwell Hardness Test of JIS Z2245, the Rockwell hardness (HRB) was measured.

The results are shown in Table 7.

TABLE 7

| | Carbon supply component | | | | Characteristics of sintered body (density of sintered body = 6.80 g/cm$^3$) | |
|---|---|---|---|---|---|---|
| Experiment | Symbol | DBP absorption (ml/100 g) | Nitrogen absorption specific surface area (m$^2$/g) | Average particle diameter of primary particles (nm) | Radial crushing strength (N/mm$^2$) | Hardness (HRB) |
| 25 | d | 38 | 8 | 300 | 811.7 | 76.4 |
| 26 | e | 22 | 24 | 80 | 818.7 | 76.8 |
| 27 | f | 49 | 24 | 78 | 810.8 | 75.9 |
| 28 | g | 44 | 9.5 | 250 | 813.4 | 75.8 |
| 29 | h | 51 | 23 | 95 | 808.2 | 74.9 |
| 30 | i | 60 | 27 | 70 | 807.7 | 75.2 |
| 37 | Graphite | | | 5000 | 820.9 | 76.3 |

Note:
Marks d through i mean carbon blacks shown in Table 5.

According to the comparison between the characteristics in the case that the sintering density is 6.80 g/cm$^3$ in Table 7, it is found that, irrespective of whatever carbon blacks are used, the mechanical characteristics (radial crushing strength and hardness) substantially same as that in the case of the graphite powder was used could be obtained. Accordingly, it is confirmed that the carbon black is very useful as the carbon supply component that substitutes the graphite powder.

While the invention has been described in detail and with reference to specific embodiments thereof, it will be apparent to one skilled in the art that various changes and modifications can be made therein without departing from the scope thereof.

This application is based on Japanese patent application No. 2006-069731 filed Mar. 14, 2006 and Japanese patent application No. 2006-069732 filed Mar. 14, 2006, the entire contents thereof being hereby incorporated by reference.

Further, all references cited herein are incorporated in their entireties.

INDUSTRIAL APPLICABILITY

According to the invention, a mixed powder which is capable of reducing dust generation or segregation of the carbon supply component can be obtained without employing a binder. Accordingly, the productivity is excellent.

Furthermore, when the mixed powder of the invention for powder metallurgy is used, a green compact which has high density and is excellent in the shape retention property can be obtained. Accordingly, finally, a sintered body excellent in the mechanical characteristics can be obtained.

The invention claimed is:

1. A mixed powder for powder metallurgy, comprising:

an iron-base powder; and a carbon supply component, wherein the carbon supply component comprises a graphite powder and a carbon black, wherein a mixing ratio of the graphite powder to the carbon black is in the range of 25 to 85 parts by weight to 75 to 15 parts by weight, and wherein the carbon black has a dibutyl phthalate absorption of 60 mL/100 g or less and a nitrogen absorption specific surface area of 50 m$^2$/g or less.

2. A mixed powder for powder metallurgy, comprising:

an iron-base powder; and a carbon supply component, wherein the carbon supply component comprises, as a main component, a carbon black having a dibutyl phthalate absorption of 60 mL/100 g or less and a nitrogen absorption specific surface area of 50 m$^2$/g or less.

3. The mixed powder for powder metallurgy according to claim 1, wherein the carbon supply component is contained in a proportion of from 4 parts by weight or less with respect to 100 parts by weight of the iron-base powder.

4. The mixed powder for powder metallurgy according to claim 1, which further comprises a physical property-improving component.

5. The mixed powder for powder metallurgy according to claim 1, which further comprises a lubricant.

6. A green compact obtainable by using the mixed powder for powder metallurgy according to claim 1.

7. A sintered body obtainable by sintering the green compact according to claim 6.

8. The mixed powder for powder metallurgy according to claim 2, wherein the carbon supply component is contained in a proportion of from 4 parts by weight or less with respect to 100 parts by weight of the iron-base powder.

9. The mixed powder for powder metallurgy according to claim 2, which further comprises a physical property-improving component.

10. The mixed powder for powder metallurgy according to claim 2, which further comprises a lubricant.

11. A green compact obtainable by using the mixed powder for powder metallurgy according to claim 2.

12. A sintered body obtainable by sintering the green compact according to claim 11.

* * * * *